US007053604B2

(12) United States Patent
Laumen et al.

(10) Patent No.: US 7,053,604 B2
(45) Date of Patent: May 30, 2006

(54) SENSOR DETECTING MOVEMENT OF A CONTROL ELEMENT MOVED BY AN ACTUATOR

(75) Inventors: Hermann-Josef Laumen, Heinsberg (DE); Gunter Gürich, Aachen (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 11/067,578

(22) Filed: Feb. 28, 2005

(65) Prior Publication Data

US 2005/0168215 A1 Aug. 4, 2005

Related U.S. Application Data

(63) Continuation of application No. PCT/EP02/09699, filed on Aug. 30, 2002.

(51) Int. Cl.
*G01B 7/14* (2006.01)
*G01B 7/30* (2006.01)
*H01F 5/00* (2006.01)

(52) U.S. Cl. ..... 324/207.19

(58) Field of Classification Search ..... 324/207.11, 324/207.15, 207.16–19, 228, 164, 163, 207.24, 324/207.19, 207.17, 207.18, 207.14; 123/406.58, 123/612, 617

See application file for complete search history.

(56) References Cited

U.S. PATENT DOCUMENTS 3,082,408 A * 3/1963 Garwin ..... 365/160
3,456,132 A * 7/1969 Dechelotte ..... 327/603
3,457,502 A * 7/1969 Cohn ..... 324/239
3,654,549 A * 4/1972 Maurer et al. ..... 324/207.16
4,623,840 A * 11/1986 Fujimura et al. ..... 324/207.16
4,667,158 A * 5/1987 Redlich ..... 324/207.19
4,717,874 A * 1/1988 Ichikawa et al. ..... 324/207.16
4,783,626 A * 11/1988 Shimizu ..... 324/207.18
4,866,378 A * 9/1989 Redlich ..... 324/207.19
5,003,258 A * 3/1991 Mancini ..... 324/207.12
5,206,587 A * 4/1993 Rose ..... 324/207.16

(Continued)

FOREIGN PATENT DOCUMENTS

DE 19918993 9/2000

(Continued)

OTHER PUBLICATIONS

Patent Abstracts of Japan, vol. 2002, No. 08, Aug. 5, 2002.

*Primary Examiner*—Bot Ledynh
*Assistant Examiner*—Kenneth J. Whittington
(74) *Attorney, Agent, or Firm*—Venable LLP; Robert Kinberg; Steven J. Schwarz

(57) ABSTRACT

A sensor for detecting movement of a control element moved by an electromagnetic actuator comprises a fixed coil arrangement having at least one coil connected to a current supply and to a signal detection device. A housing circumferentially encloses the fixed coil arrangement. The housing comprises a magnetically conductive material with poor electrical conductivity. An axially movable rod-shaped sensor part of a magnetizable material is connected to the control element. A short circuit element comprised of an electrically conductive material with low ohmic resistance is disposed on the rod-shaped element and is delimited in a longitudinal direction of the rod-shaped element by two outer edge regions. The short circuit element is dimensioned in the movement direction of the rod-shaped element so that only one of the outer edge regions of the short circuit element is always positioned inside the fixed coil arrangement during the back and forth movement in a stroke region of the fixed coil arrangement.

10 Claims, 8 Drawing Sheets

U.S. PATENT DOCUMENTS

| | | | | |
|---|---|---|---|---|
| 5,327,030 | A * | 7/1994 | DeVito et al. | 327/355 |
| 5,331,277 | A * | 7/1994 | Burreson | 324/207.16 |
| 5,777,467 | A * | 7/1998 | Arms et al. | 324/207.18 |
| 5,898,300 | A * | 4/1999 | Heizmann et al. | 324/207.12 |
| 6,034,624 | A * | 3/2000 | Goto et al. | 340/870.32 |
| 6,891,364 | B1 * | 5/2005 | Boie et al. | 324/207.19 |

FOREIGN PATENT DOCUMENTS

| | | | |
|---|---|---|---|
| DE | 10154383 | | 5/2002 |
| DE | 10157119 | | 6/2002 |
| DE | 10157119 | A1 * | 6/2002 |
| JP | 2002115515 | | 4/2002 |

* cited by examiner

SENSOR DETECTING MOVEMENT OF A CONTROL ELEMENT MOVED BY AN ACTUATOR

CROSS-REFERENCE TO RELATED APPLICATIONS

This application is a continuation of International Application No. PCT/EP2002/009699, filed Aug. 30, 2002, and designating the United States.

BACKGROUND OF THE INVENTION

The armature movement of an actuator, in particular an electromagnetic actuator, used for moving a control element back and forth coincides with the movement of the control element, making it possible to detect the armature movement and thus also the control element movement for the actuator operating range.

With an electromagnetic actuator having two spaced-apart electromagnets with oppositely arranged pole faces, between which an armature subjected to an alternating current is guided back and forth counter to the force of restoring springs, the armature movement can be inferred from the current and/or voltage values detected at the respectively capturing magnet and/or the respectively holding magnet upon release, and the detected values can be used for triggering purposes, following a corresponding signal processing.

An electromagnetic actuator of this type is used, for example, in the form of a fully variable valve actuator for triggering a gas cylinder valve on an internal combustion engine. Detecting a movement by inferring it from the current and voltage courses at the electromagnet coils is no longer sufficient to meet the higher requirements for triggering accuracy, particularly with respect to influencing the impact speed between armature and pole face of the respective capturing magnet, and thus also for the valve seating speed at the valve seat, because the signals obtained in this way cannot be converted for use until the following stroke cycle.

For that reason, the armature movement and thus also the control element movement must be detected "online" and over the complete stroke length by a corresponding sensor, so as to influence the current flow to the electromagnets during the control element movement by means of signals which correspondingly trigger the actuator, e.g. an electromagnetic actuator, so that the armature movement can be guided even during the current stroke cycle.

This requirement can be met with just one distance-measuring sensor which generates a signal during the complete stroke movement, meaning it "plots" the stroke path, wherein the sensor should be protected as much as possible against interference because of the resolution and accuracy requirements for gas cylinder valves, but also injection nozzles and needle valves, due to the relatively short stroke distances. The same is also true for other applications where the movement of a back and forth moving component, e.g. a piston movement or the like, must be detected with high accuracy.

A sensor of this type is known in principle from German patent document DE 101 57 119 A, but requires a relatively long structural length if precise measuring signals are desired.

SUMMARY OF THE INVENTION

It is an object of the present invention to create a sensor that has the performance of the known sensor, but has a noticeably shorter structural length.

The above and other objects are accomplished according to the invention by the provision of a sensor for detecting movement of a control element moved by an electromagnetic actuator, comprising: a fixed coil arrangement having at least one coil connected to a current supply and to a signal detection device; a housing circumferentially enclosing the fixed coil arrangement, the housing comprising a magnetically conductive material with poor electrical conductivity; an axially movable rod-shaped sensor part comprised of a magnetizable material connected to the control element; and a short circuit element disposed on the rod-shaped element, delimited in a longitudinal direction of the rod-shaped element by two outer edge regions and comprising an electrically conductive material with low ohmic resistance, the short circuit element being dimensioned in the movement direction of the rod-shaped element so that only one of the outer edge regions of the short circuit element is always positioned inside the fixed coil arrangement during the back and forth movement in a stroke region of the fixed coil arrangement.

Generating signals by a field change in the respective coils, as explained in further detail below, is effected by changing the immersion length, which changes with the stroke, for the short circuit element in the coil. The short circuit element should be longer than the coil, so that depending on the stroke position, the coil is filled either with the short circuit element material with high electrical conductivity or the preferably magnetizable sensor part material with poor electrical conductivity. The sensor part material in this case can be a soft magnetic or a hard magnetic material. A sensor of this type has a clearly shorter structural length and can be used, for example, so that for two control elements that are alternately triggered by an actuator, the coils of the sensor for each actuator are interconnected to form a half-bridge, so that respectively the coil arrangement of the non-activated control element takes over the function of a passive coil, meaning it functions as a compensation coil in the bridge circuit. The only requirement is that the sensor in particular is subjected to substantially the same environmental influences, particularly temperature influences.

When using electromagnetic actuators for triggering gas cylinder valves in a piston internal combustion engine, the coils are interconnected to connect respectively one non-activated and one activated gas cylinder valve in the half bridge, corresponding to the firing sequence.

According to one advantageous embodiment, the coil arrangement is provided with one active coil with considerable extension lengthwise and, relative to the movement direction of the short-circuit element, is provided with a short passive coil, in front of and/or behind the active coil, wherein no outer edge region of the short-circuit element passes over the passive coil during the control element movement. As a result, it is ensured that the so-called passive coils do not experience a field change during the control element movement and thus take over the function of compensation coils in the bridge circuit. Since the passive coils which function as compensation coils only need to have a correspondingly short structural length, the complete structural length can be cut nearly in half as compared to the previously known sensor. In the process, only a slight, negligible increase in the susceptibility to interference from external influences results. The linearity can be further improved by winding-technology measures, for example a purposeful uneven winding, additional compensation winding, or similar measures. When arranging two passive coils such that respectively one is assigned to each end of an active coil, it makes sense if these are wound in the same direction, are connected in series and in the form of quarter bridge elements, and are interconnected with the active coil to form a half bridge.

Admitting the coil arrangement of a sensor of this type with high-frequency alternating current will generate a high frequency magnetic field which acts upon the short-circuit element connected to the rod-shaped sensor part, thus generating eddy currents in the short-circuit element. The eddy currents in turn generate an opposing magnetic field that counteracts the originating high-frequency magnetic field by causing a field displacement. The resulting field change in the coil is noticeable on the outside through a change in the inductance. If the rod-shaped sensor part with its opposing field is moved relative to the coil arrangement, then the distance traveled by the sensor part and thus also the distance traveled by the control element can be detected with a corresponding evaluation circuit, in a non-contacting manner via the change in the inductance caused by the field change. The rod-shaped sensor part consists of a magnetically permeable or a magnetically conducting material. The short-circuit element can be a short circuit ring fitted onto the rod-shaped sensor part. Instead of using a short circuit ring, it is also possible to divide the rod-shaped sensor part of magnetizable material and to insert a rod-shaped, rigidly connected intermediate section of an electrically conductive material.

To reduce the effects of interfering external influences, a housing of a magnetically conductive material with poor electrical conductivity is provided which substantially encloses the coil arrangement. This is particularly important if the sensor is directly connected to the actuator and if the actuator is designed as an electromagnetic actuator because triggering the electromagnets of the actuator can lead to the development of interfering fields.

In principle, the material for the ring-shaped short-circuit element can be deposited with the vapor-depositing technique or a similar technique as a thin layer onto the rod-shaped sensor part. However, it is advantageous if the short-circuit element in form of a short circuit ring has a noticeable wall thickness, preferably ranging from 0.1 to 0.5 mm. As a result, it is possible to compensate a certain temperature dependence of the sensor by correspondingly adapting the wall thickness.

This is particularly important for sensors used in combination with actuators which are subjected to changing operating temperatures, for example actuators for triggering gas cylinder valves in piston internal combustion engines. With the preferred use of copper or also aluminum as a material for the short-circuit element, it follows that for a given voltage the specific resistance of the short-circuit element material increases with the increase in temperature and, correspondingly, the intensity of the opposing magnetic field decreases and/or the resulting magnetic field increases.

On the other hand, the high-frequency magnetic field which acts via the coil arrangement on the short-circuit element causes a skin effect for the electrical currents induced in the short-circuit element, meaning the eddy currents only flow in a thin layer along the outer edge of the short circuit ring.

To be sure, the specific electrical resistance of the short circuit ring increases with the increase in the temperature. However, the eddy currents also penetrate deeper into the short circuit ring material, so that the temperature-induced rise in the specific electrical resistance is mostly compensated by a correspondingly larger conductor cross section. By limiting the thickness of the short-circuit element, particularly the wall thickness of the short-circuit element, the eddy current penetration with increasing temperature is limited as well, causing the eddy currents to decrease above a specific temperature. The temperature course of the sensor can thus be influenced by means of the short circuit ring thickness. Given a suitable selection of the wall thickness, additional thermally-caused influences can also be compensated in part, for example the dependence of the magnetic core material and the casing material permeability on the temperature.

A different embodiment of the invention is provided with a carrier frequency measuring bridge for the current supply and the signal detection. This measuring bridge comprises a frequency generator, wherein the two coils of the coil arrangement form a portion of the measuring bridge. The frequency generator in this case advantageously generates a high carrier frequency, e.g. with a magnitude of 100 kHz.

Additional embodiments and advantages of the invention are disclosed in the following description and the drawings by using exemplary embodiments.

BRIEF DESCRIPTION OF THE DRAWINGS

The invention is explained in further detail in conjunction with the accompanying drawings.

DETAILED DESCRIPTION OF THE INVENTION

Figure 1:
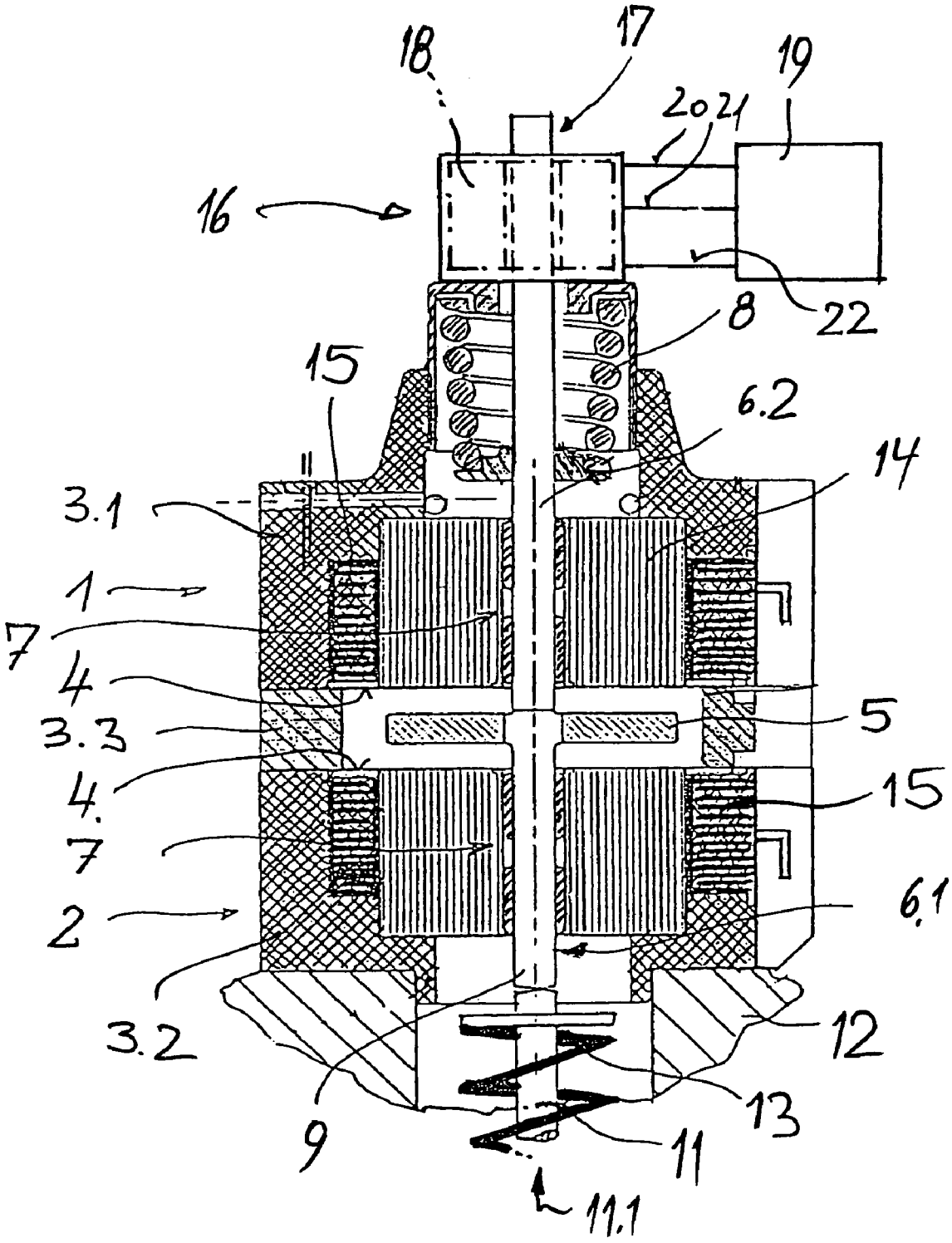
FIG. 1 shows an electromagnetic actuator for triggering a gas cylinder valve together with a sensor according to the invention.

Referring to FIG. 1, there is shown an electromagnetic actuator which essentially comprises two electromagnets 1 and 2, having oppositely arranged and facing pole faces 4. The electromagnets 1 and 2 are enclosed by two housing sections 3.1 and 3.2, respectively, that are positioned spaced apart with a housing section 3.3 disposed in-between which functions as a spacer. An armature 5 is positioned in the movement space between the two pole faces 4, enclosed by the housing section 3.3, wherein the armature can be moved back and forth by a guide bolt 6.1 that moves inside a guide 7.

The armature 5 is connected to a restoring spring 8 by means of a guide bolt 6.2 which supports itself on the guide bolt 6.1 in the operating region for armature 5. The lower, exposed end 9 of the guide bolt 6.1 in this case is supported on a control member, e.g. the exposed end of a shaft 11 of a gas cylinder valve which is guided inside a cylinder head 12, only partially indicated herein, of a piston internal combustion engine. A restoring spring 13 acts upon the gas cylinder valve in a closing direction (arrow 11.1), wherein the force of the restoring spring 13 and the force of the restoring spring 8 must be effective in opposing directions, so that when the current to the electromagnets 1, 2 is shut off, the armature 5 assumes a resting position in the center between both pole faces 4 of electromagnets 1 and 2, as shown in FIG. 1.

The housing sections 3.1 and 3.2 of the two electromagnets respectively enclose preferably one cube-shaped yoke body 14 that is provided with recesses into which a ring-shaped coil 15 is inserted which can alternately be supplied with current for opening and closing the gas cylinder valve by a control device that is not shown further herein.

The actuator end that faces away from the gas cylinder valve is provided with a sensor 16, essentially comprising a rod-shaped sensor part 17, e.g. a so-called measuring rod, which for all practical purposes represents an extension of the spring bolt 6.2. The rod-shaped sensor part 17, which is preferably made of a magnetizable material and preferably an electrically poorly conductive material, is enclosed by a coil arrangement 18 that is connected to a voltage supply and signal detection device 19. During operation, an alternating current and/or an alternating voltage which is proportional to the path traveled by the sensor part and thus the path traveled by the armature 5 is generated in the coil arrangement 18 as a result of the back and forth movement of the rod-shaped sensor part 17, depending on the circuit arrangement and the configuration of the sensor. Through direct tapping, the armature path can be detected as a signal and a speed-proportional signal can then be generated by differentiating the path signal.

Figure 2:
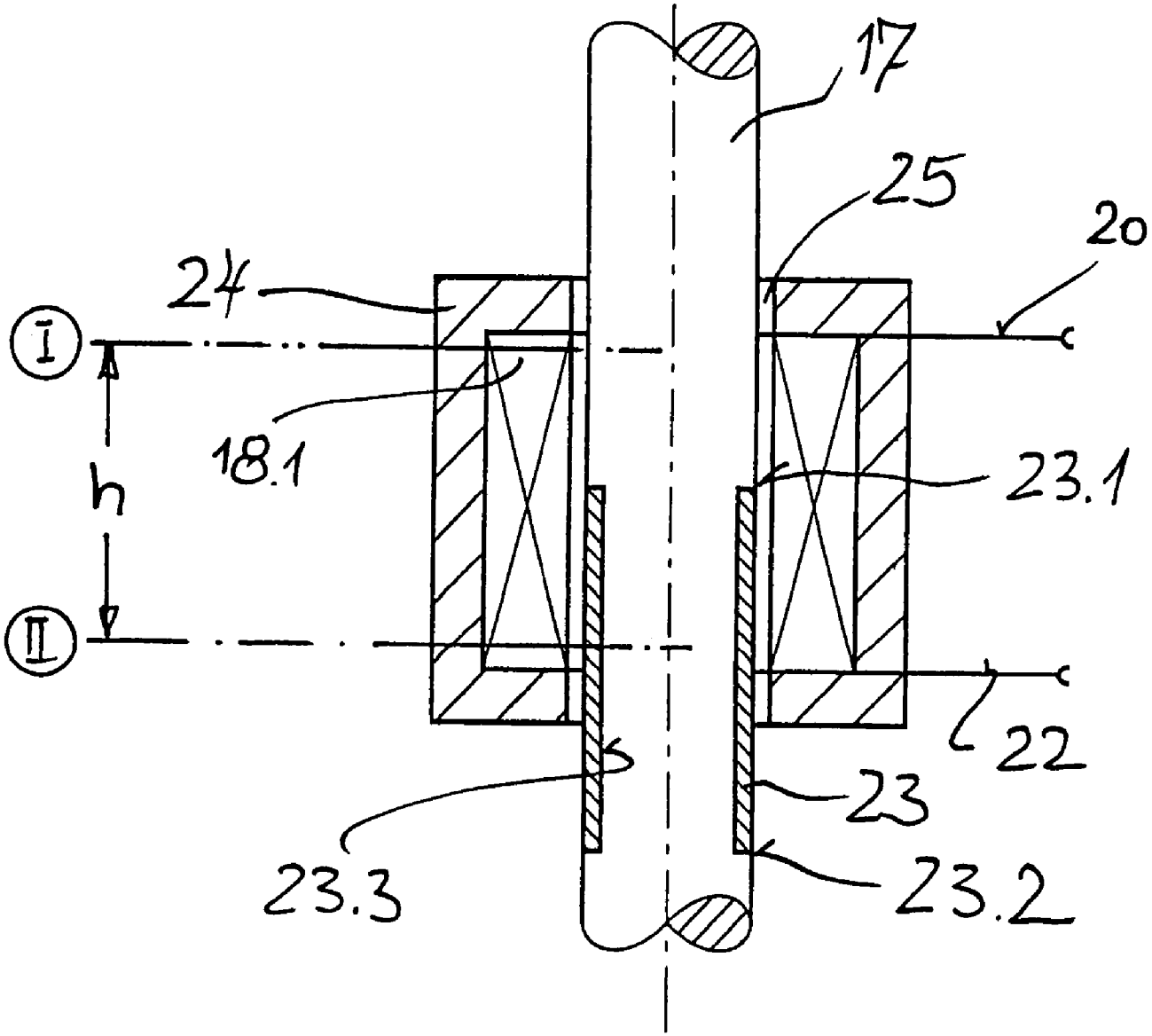
FIG. 2 is a section through a basic sensor shown on a larger scale.

The basic sensor layout, shown in FIG. 2, essentially comprises the rod-shaped sensor part 17 that is enclosed by the coil arrangement 18 which is connected via corresponding feed lines 20 and 22 to the voltage supply and detection device 19. In the exemplary embodiment shown in FIG. 2, the coil arrangement 18 has only one coil 18.1.

The rod-shaped sensor part 17, shown herein, has a short-circuit element 23 in the form of a ring and/or a sleeve of an electrically conductive material with low ohmic resistance, a so-called short circuit ring. The short circuit ring 23 has two outer edge regions 23.1 and 23.2 and its longitudinal extension in the movement direction is dimensioned to allow only one outer edge region to sweep across the coil 18.1, in this case the outer edge region 23.1, shown in a center position of the control element, between end positions I and II of the total stroke h. In the end position I, the coil 18.1 is covered almost completely by the material of the short-circuit element while in the end position II, the coil 18.1 is filled almost completely with the magnetically conductive material of the rod-shaped sensor part. The inductance of coil 18.1 changes in proportion to the displacement of the outer edge region 23.1, relative to the coil length.

A sensor of this type operates on the basis of the eddy current principle. If the coil arrangement 18 is admitted with a high-frequency alternating current, so that a high-frequency magnetic field is generated, electrical voltages are induced in the short circuit ring 23 which are converted into eddy currents by the short circuit. These eddy currents in turn generate an opposing magnetic field which, in the form of a field change, counteracts the high-frequency magnetic field of the coil arrangement 18. If the rod-shaped sensor part 17 moves, the direction and path of the field change relative to the coil arrangement is visible on the outside by a change in the inductance which depends on the movement of the rod-shaped sensor part 17. Thus, the position and also the path traveled by the sensor part 17 can be detected by means of a corresponding signal.

The coil arrangement 18 is enclosed on all sides by a housing 24, except for the through opening 25 for the rod-shaped sensor part 17. The housing 24 consists of a material with high magnetic conductivity but poor electrical conductivity and serves to protect the coil arrangement 18 against the effects of external magnetic fields. The coil 18.1 can be secured, for example, inside the housing 24 by means of casting compound.

The short circuit ring 23 is of a material with high electrical conductivity, advantageously copper or aluminum, having a thickness in a range of about 0.1 to 0.5 mm. With the exemplary embodiment shown herein, the short circuit ring 23 is inserted into a groove 23.3 in the rod-shaped sensor part 17. The rod-shaped sensor part 17 in this case can also be the control element to be actuated, for example an injection pin on an injection nozzle or the shaft of a gas cylinder valve, so that the rod-shaped sensor part 17 extends through the complete length of the coil arrangement, or it can also be a corresponding bolt on the actuator armature or a measuring rod connected thereto. The short-circuit element for the embodiment according to FIG. 2, in this case the short circuit ring 23, extends in the movement direction at least to the length of the coil arrangement.

Figure 3:
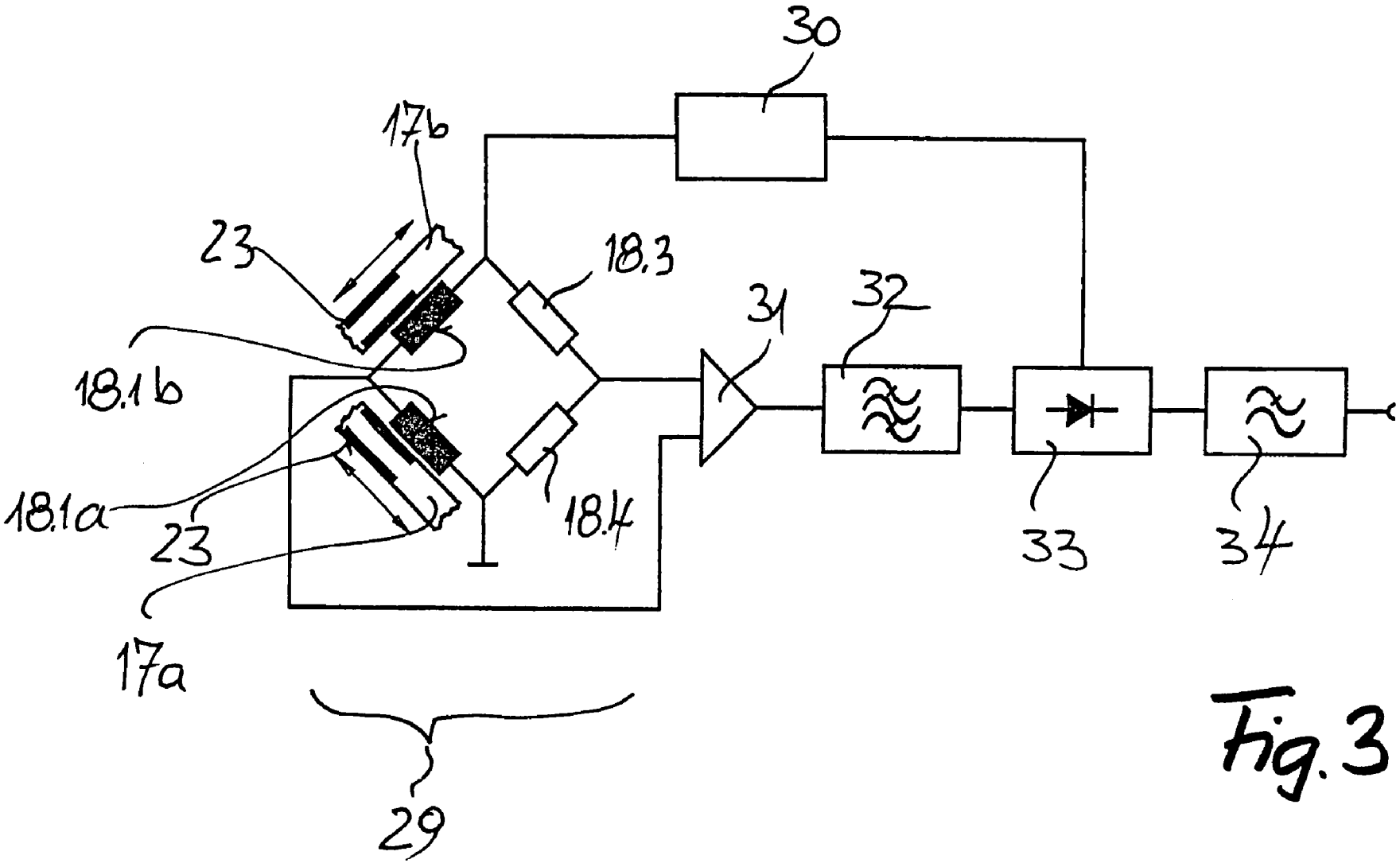
FIG. 3 is a circuit arrangement.

For detecting measuring values generated by the embodiment of FIG. 2, reference is made to FIG. 3 which shows a circuit schematic including a carrier frequency measuring bridge. Two coils 18.1*a* and 18.1*b* of two respective coil arrangements 18 for two respective sensors, are interconnected with two additional impedances, e.g. the coils 18.3 and 18.4, to form a carrier frequency measuring bridge 29. This bridge 29 is supplied with high-frequency alternating current via a frequency generator 30.

A magnetic field change occurs if the respectively active, rod-shaped sensor part with its short circuit ring is moved relative to its coil, e.g. the coil 18.1*a* of the bridge 29. The resulting "detuning" of the bridge 29 can be detected by means of an amplifier 31 and band pass filter 32. A signal which may be phase-selective can be generated with the aid of rectifier 33 and low pass filter 34. This signal can be processed for control purposes, e.g. for triggering the gas cylinder valves. The other, passive coil 18.1*b* at the "idle," (i.e. non-triggered) control element, in that case functions as a compensation coil.

With a circuit as shown in FIG. 3, respectively two actuators can be interconnected with their sensors to form a joint bridge by making use of the low structural height of a sensor as shown in FIG. 2. The only requirement is that both control elements be operated so that respectively one control element is in the idle position while the other control element is activated. The coil arrangement for the respectively "idle" control element then forms the compensation coil for the circuit while the coil of the "moving" control element represents the active coil. In each case, the passive coil functions to complement the quarter bridge to form a half bridge and is then used for interference compensation, wherein it is only necessary that the associated path sensors are subjected to substantially the same environmental influences, e.g. the same temperature situation.

Figure 4:
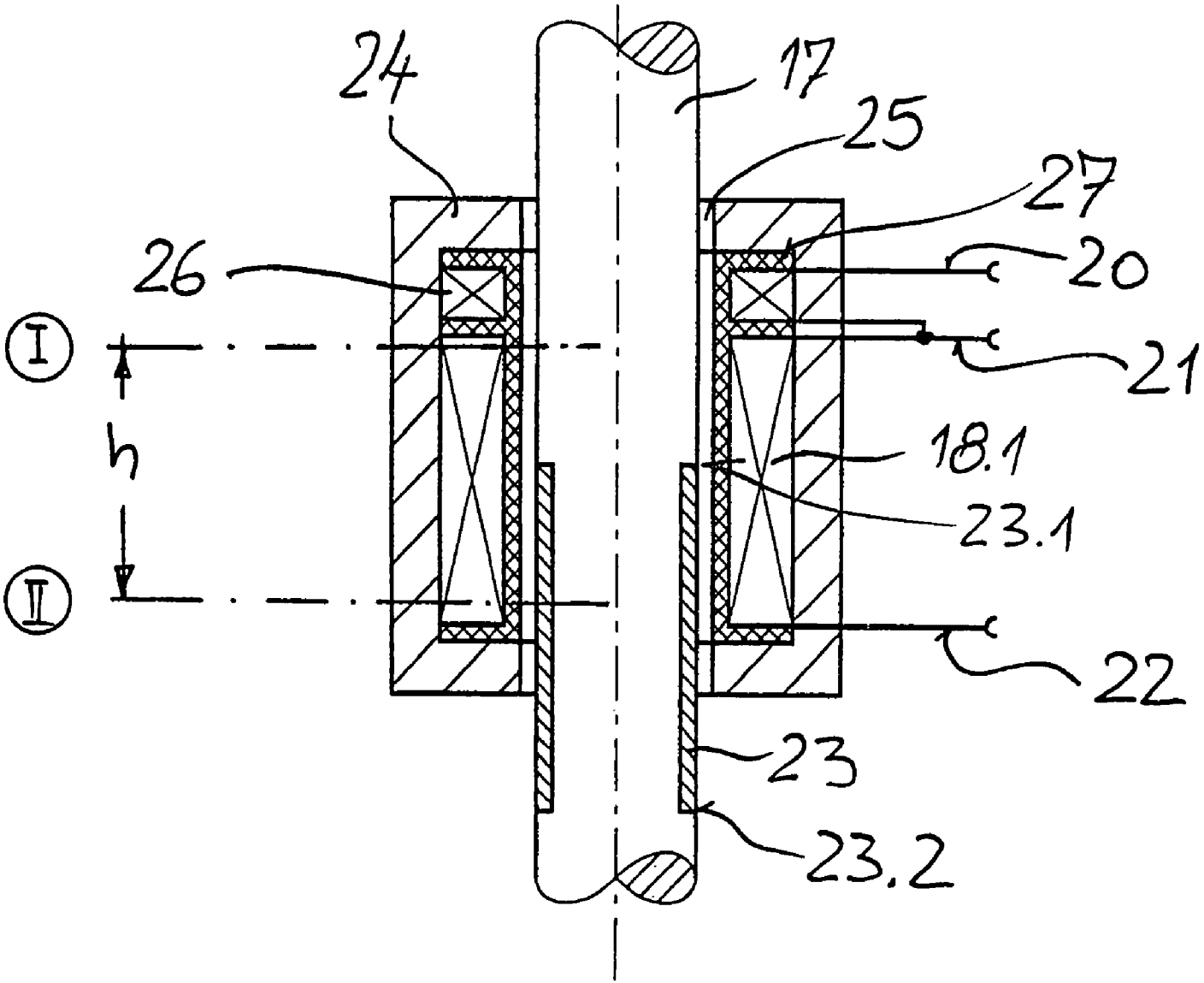
FIG. 4 shows a modification of the embodiment according to FIG. 2.

The coil arrangement shown in FIG. 4 is modified as compared to the one shown in FIG. 2 and comprises a "long" active coil 18 and a comparably much shorter passive coil 26 which are wound onto a coil carrier 27 of a magnetically permeable insulating material, positioned inside the housing 24. The coil 26 for the embodiment shown herein is arranged in a region positioned outside of the stroke region h across which the outer edge region 23.1 sweeps, so that only the magnetically conductive material of the sensor part 17 moves across the passive coil 26 when the rod-shaped sensor part 17 moves.

Figure 6:
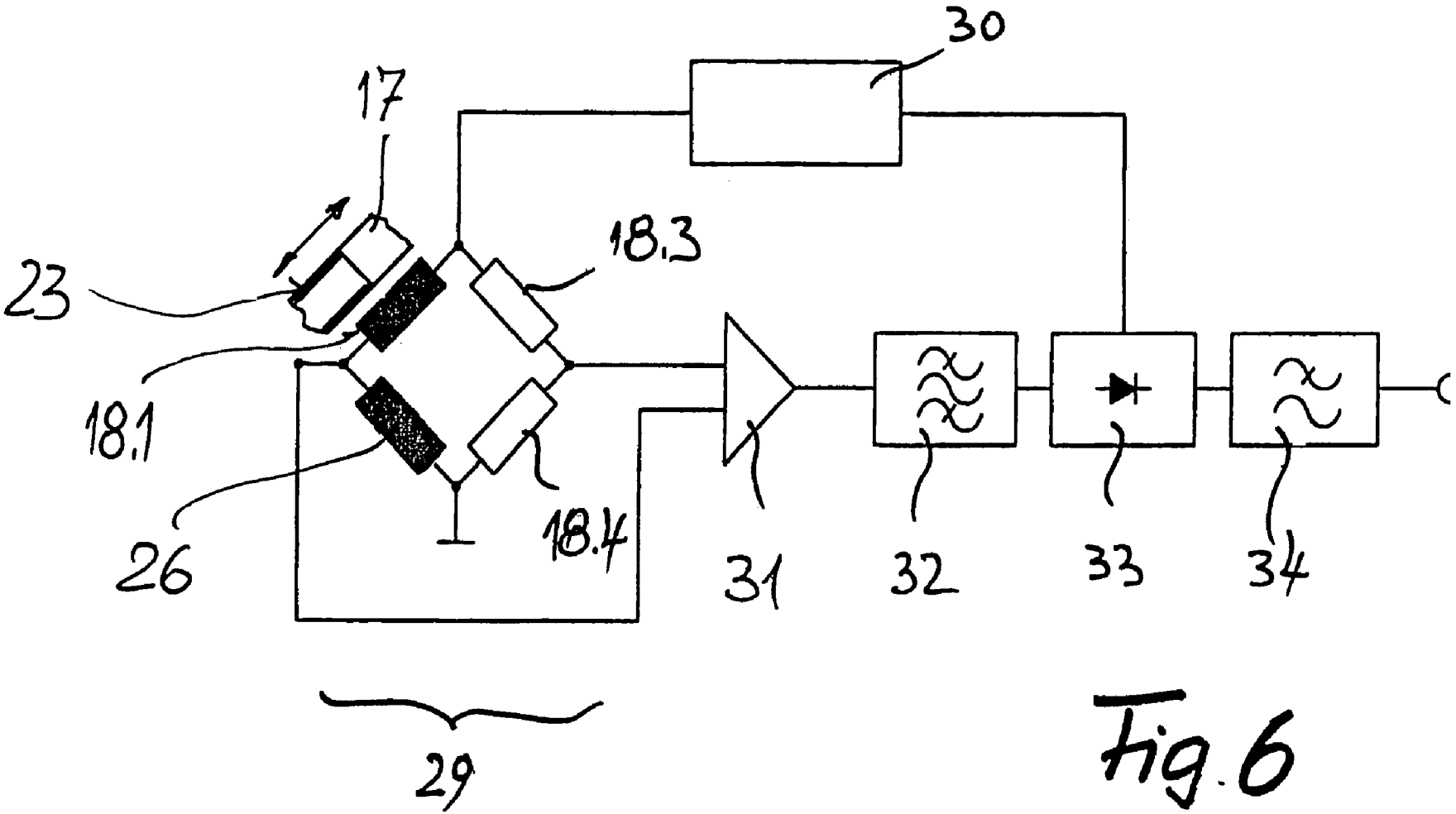
FIG. 6 shows a circuit arrangement for the embodiments shown in FIGS. 4 and 5.

The coil 26 is connected to the input 22 for the active coil 18, thus forming the bridge circuit shown in FIG. 6.

Figure 5:
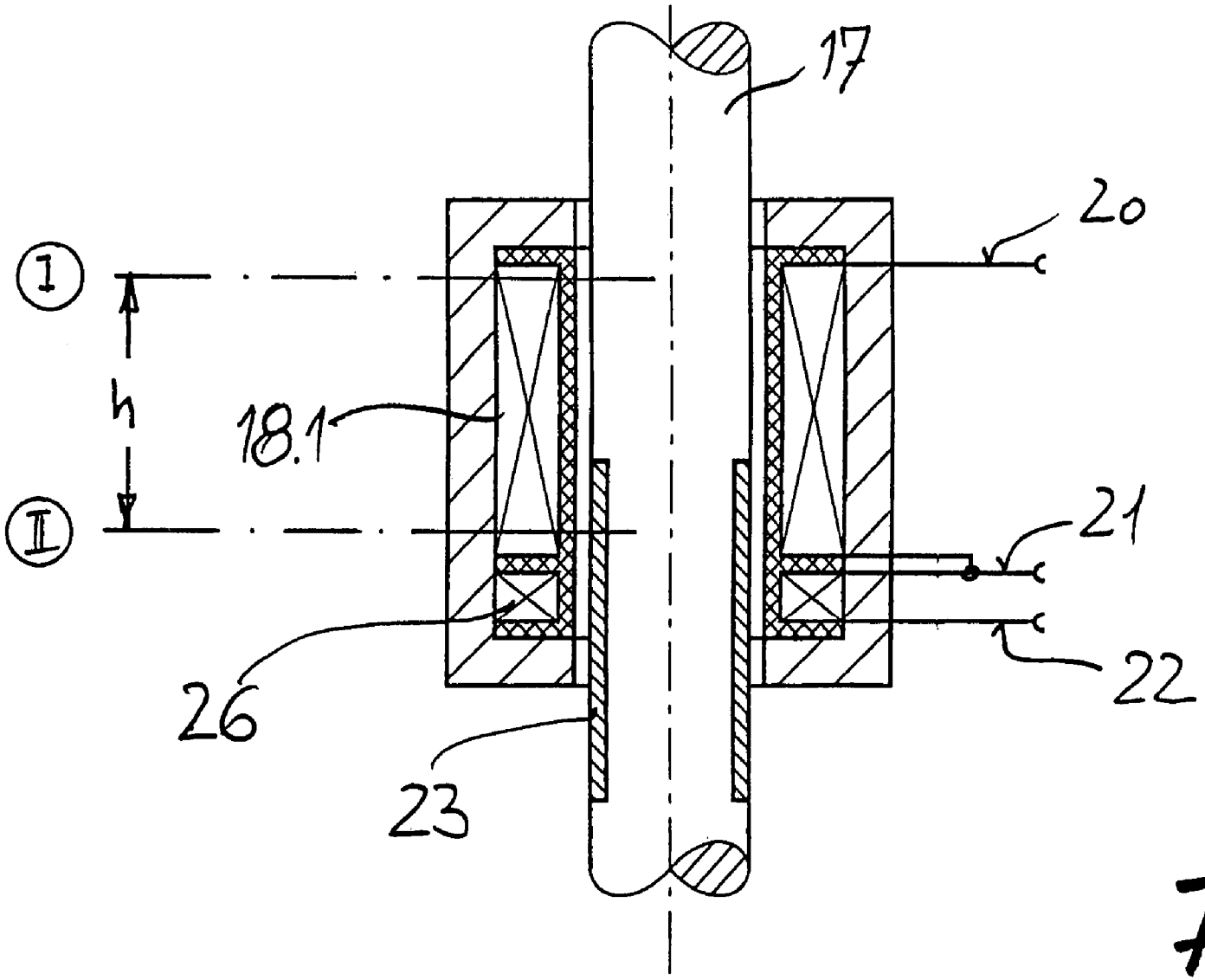
FIG. 5 shows a further modification of the embodiment according to FIG. 2.

FIG. 5 shows a modified version of the embodiment according to FIG. 4, wherein the short passive coil 26 is again located outside of the stroke region h across which the outer edge region 23.1 sweeps. In this case, only the electrically conductive material of the short circuit element 23 moves across the coil. The circuit arrangement as shown in FIG. 6 can be used in this case as well.

Figure 7:
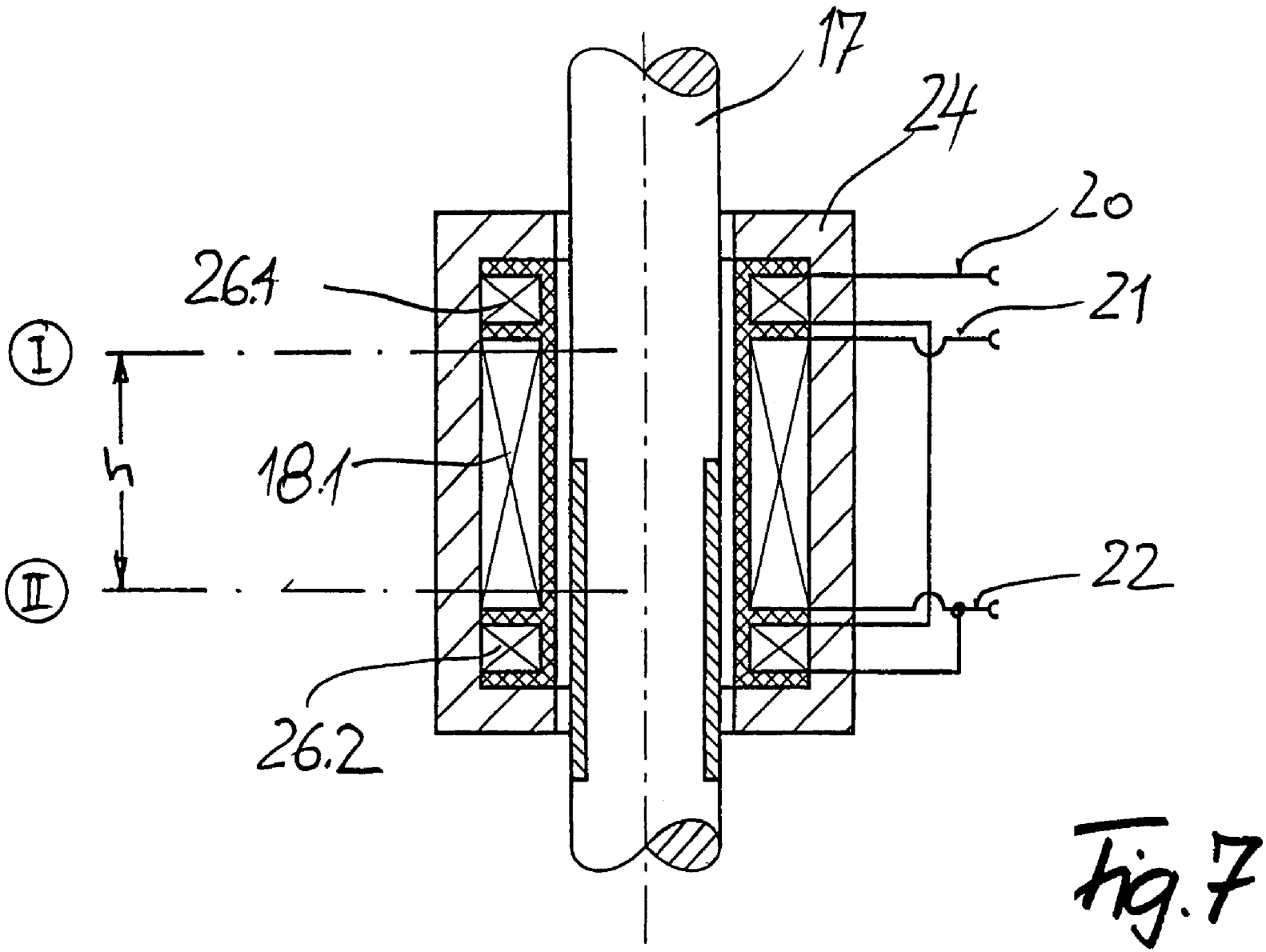
FIG. 7 shows a another modification of the embodiment according to FIG. 2.
Figure 8:
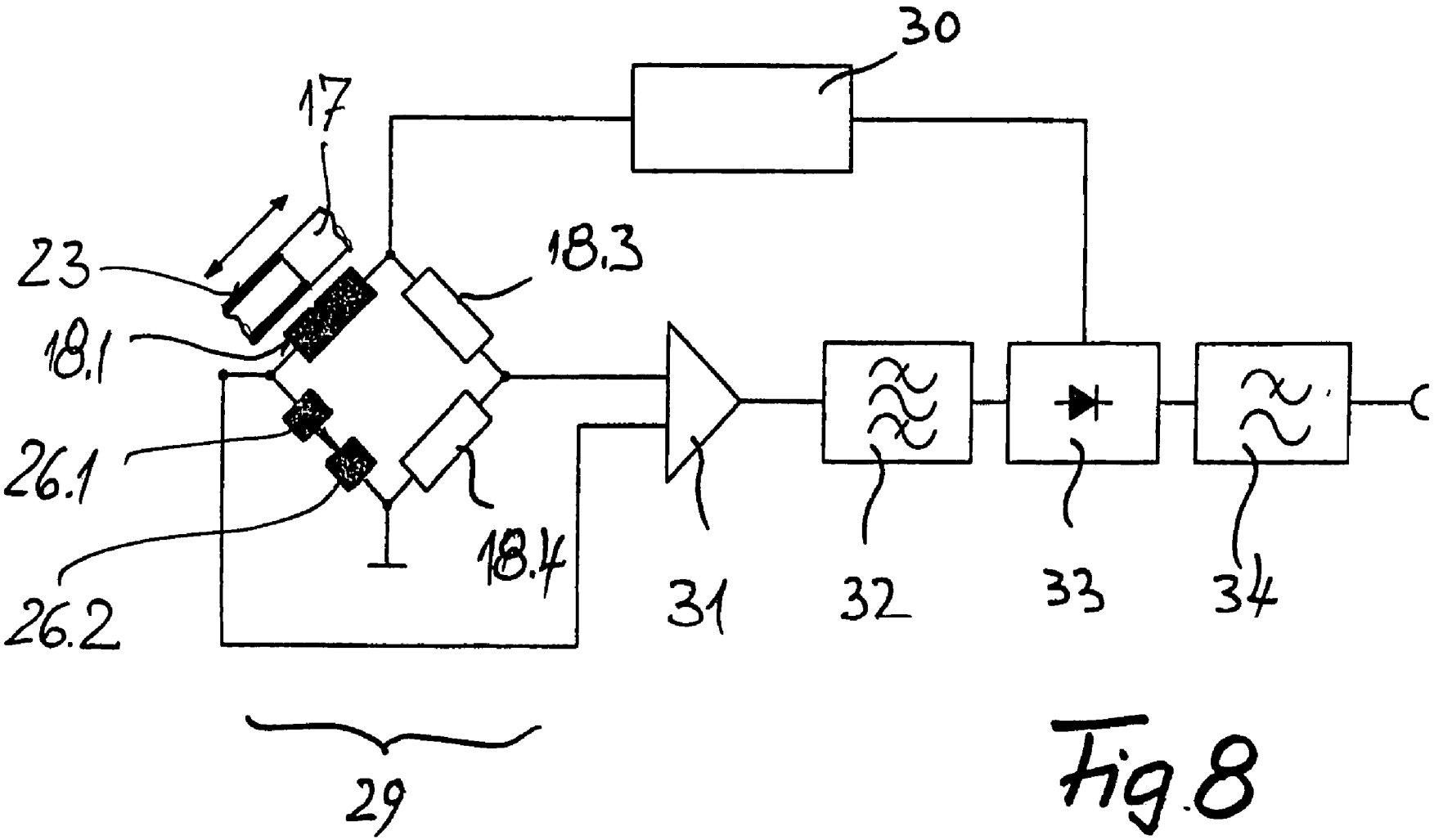
FIG. 8 is a circuit arrangement for the embodiment shown in FIG. 7.

FIG. 7 illustrates a combination of the two embodiments shown in FIGS. 4 and 5, wherein two short passive coils 26.1 and 26.2 are respectively arranged outside of the stroke region h. These coils are connected in series, as shown in FIG. 8, and are linked to a feed line for the active coil 18, as shown. FIG. 8 contains the associated circuit arrangement.

The short circuit element 23 for the illustrated embodiments takes the form of a short circuit ring. However, it is also possible to divide the rod-shaped sensor part 17 into partial lengths and insert a rod-shaped intermediate section, e.g. made of copper, which is rigidly connected to these partial lengths by means of welding, soldering, and the like. This intermediate section then forms the short circuit element 23. Again, the extension in the movement direction corresponds at least to the length of the active coil 18.1.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A sensor for detecting movement of a control element moved by an actuator, comprising:

a fixed coil arrangement having at least one coil connected to a current supply and to a signal detection device, the at least one coil comprising an active coil having outer end regions and first and second short passive coils arranged in each of the outer end regions;

a housing circumferentially enclosing the fixed coil arrangement, the housing comprising a magnetically conductive material with poor electrical conductivity;

an axially movable rod-shaped sensor element comprised of a magnetizable material connected to the control element, the magnetizable material being electrically poorly conductive; and a short circuit element disposed on the rod-shaped element, delimited in a longitudinal direction of the rod-shaped sensor by two outer edge regions and comprising an electrically conductive material with low ohmic resistance, the short circuit element being dimensioned so that during movement within a stroke region of the control element, only the electrically poorly conductive material of the rod-shaped element will sweep across one of the first and second passive coils, while only the electrically conductive material of the short circuit element will sweep across the other of the first and second passive coils.

2. The sensor according to claim 1, further comprising a quarter bridge element interconnected with the active coil to form a half bridge, the quarter bridge element comprising the first and second passive coils wound in the same direction and connected in series.

3. The sensor according to claim 1, wherein the at least one coil is an active coil and is purposely wound unevenly.

4. The sensor according to claim 1, wherein the short circuit element has a length that corresponds at least to a length of the coil arrangement.

5. The sensor according to claim 1, wherein the short circuit element has a wall thickness dimensioned to substantially compensate for temperature influence on the sensor.

6. The sensor according to claim 1, further comprising two control elements triggered alternately by respective actuators, with one of the control elements being active while the other of the control elements is passive, wherein the fixed coil arrangement includes two active coils which are assigned to the two actuators, respectively, and which are interconnected to form a half bridge so that respectively the coil of a non-triggered actuator performs the function of a passive coil.

7. The sensor according to claim 1, further comprising a current supply and signal detection device comprising a carrier frequency measuring bridge which is constituted by the active coil and the passive coil of the coil arrangement.

8. A method for detecting movement of a control element moved by an electromagnetic actuator for triggering a gas cylinder valve in a piston internal combustion engine, comprising utilizing the sensor defined in claim 1.

9. The sensor according to claim 1, wherein the short circuit element has a length that corresponds at least to a combined length of the active coil and one of the passive coils.

10. A sensor for detecting movement of first and second control elements triggered alternatively by respective actuators, with one of the control elements being active while the other of the control elements is passive, comprising:

first and second fixed coil arrangements connected to a current supply and to a signal detection device, the fixed coil arrangements each comprising an active coil having outer end regions with a short passive coil arranged in one of the outer end regions;

a housing circumferentially enclosing the fixed coil arrangements, the housing comprising a magnetically conductive material with poor electrical conductivity;

first and second axially movable rod-shaped sensor elements comprised of a magnetizable material connected to the first and second control elements, respectively; and first and second short circuit elements disposed on the rod-shaped elements, respectively, the first and second short circuit elements each being delimited in a longitudinal direction of the rod-shaped elements by two outer edge regions and comprising an electrically conductive material with low ohmic resistance, each of the short circuit elements being dimensioned so that during movement within a stroke region of the control elements, only one of the outer edge regions of each short circuit element is always positioned inside the fixed coil arrangements, and so that neither of the outer edge regions of each of the short circuit elements passes across the passive coils;

wherein the two active coils are interconnected to form a half bridge so that the coil of a non-triggered actuator performs the function of a passive coil.

* * * * *